US011287228B2

(12) United States Patent
Haddon

(10) Patent No.: US 11,287,228 B2
(45) Date of Patent: Mar. 29, 2022

(54) INITIATOR UNIT

(71) Applicant: Timothy Haddon, Haywards Heath (GB)

(72) Inventor: Timothy Haddon, Haywards Heath (GB)

( * ) Notice: Subject to any disclaimer, the term of this patent is extended or adjusted under 35 U.S.C. 154(b) by 85 days.

(21) Appl. No.: 16/402,791

(22) PCT Filed: Nov. 7, 2017

(86) PCT No.: PCT/GB2017/053333
§ 371 (c)(1),
(2) Date: May 3, 2019

(87) PCT Pub. No.: WO2018/083497
PCT Pub. Date: May 11, 2018

(65) Prior Publication Data

US 2019/0376770 A1 Dec. 12, 2019

(30) Foreign Application Priority Data

Nov. 7, 2016 (GB) ..... 1618741

(51) Int. Cl.
*F42B 3/182* (2006.01)
*F42D 1/045* (2006.01)
*F42B 4/00* (2006.01)

(52) U.S. Cl.
CPC ..... *F42B 3/182* (2013.01); *F42D 1/045* (2013.01); *F42B 4/00* (2013.01)

(58) Field of Classification Search
CPC .... F42B 3/18; F42B 3/182; F42B 4/00; F42D 1/045; F42D 1/05; F41A 19/69;
(Continued)

(56) References Cited

U.S. PATENT DOCUMENTS

RE16,544 E * 2/1927 Grant ..... F42B 3/18 102/202.3
2,247,384 A * 7/1941 Huyett ..... F42B 3/182 102/202.3

(Continued)

FOREIGN PATENT DOCUMENTS

DE 8504280 U1 * 7/1985 ..... H01R 31/08
EP 0609485 A1 * 8/1994 ..... F42B 4/00
GB 1580579 A * 12/1980 ..... F42B 3/12

*Primary Examiner* — James S Bergin
(74) *Attorney, Agent, or Firm* — The Rapacke Law Group P.A.

(57) ABSTRACT

An electronic initiator unit for the electrical firing of a charge in an energetic device is described. The unit includes an actuation module comprising electrically in series a first conductor, an electronic actuator, and a second conductor; an engagement module including a first electrical connector conductively connected to the first conductor and defining a first connector contact portion spaced remotely from the first conductor and a second electrical connector conductively connected to the second conductor and defining a second connector contact portion spaced remotely from the second conductor; a shunt module including a first shunt connector defining a first shunt contact portion, a second shunt connector defining a second shunt contact portion, and a conductive shunt connection between the first and second shunt connector spaced remotely from the shunt contact portions; wherein the engagement module and the shunt module are co-operably configured so as to be engageable together such as to effect when so engaged an electrical connection between the first connector contact portion and the first shunt contact portion and between the second connector contact portion and the second shunt contact portion. A system and method for the electrical firing of a charge in a plurality of energetic devices in a controlled manner from a remote location are also described.

12 Claims, 3 Drawing Sheets

(58) Field of Classification Search
CPC ..... H01R 13/703; H01R 13/7031; H01R 13/7032; H01R 31/08; H01R 31/085
USPC ..... 102/202.1, 202.2, 202.3, 202.11
See application file for complete search history.

(56) References Cited

U.S. PATENT DOCUMENTS

| | | | | | |
|---|---|---|---|---|---|
| 2,632,389 | A * | 3/1953 | McFarland | F42B 3/182 | 102/202.3 |
| 3,182,277 | A * | 5/1965 | Ashby | H01R 13/6592 | 439/509 |
| 4,378,738 | A * | 4/1983 | Proctor | F42B 3/188 | 102/202.12 |
| 4,592,280 | A * | 6/1986 | Shores | F42B 3/188 | 102/202.14 |
| 4,607,899 | A * | 8/1986 | Romine | H01R 31/08 | 29/845 |
| 10,615,547 | B2 * | 4/2020 | Summers | H01R 13/7031 | |
| 10,662,898 | B2 * | 5/2020 | Summers | F02K 9/97 | |
| 2011/0107934 | A1 * | 5/2011 | Rustick | F42B 3/12 | 102/202.7 |
| 2014/0134869 | A1 * | 5/2014 | Hamai | H01R 13/62 | 439/345 |

* cited by examiner

INITIATOR UNIT

CROSS-REFERENCE TO RELATED APPLICATIONS

The present invention claims priority to PCT application number PCT/GB2017/053333 filed on Nov. 7, 2017 entitled "INITIATOR UNIT" the entire disclosure of which is incorporated by reference herein.

TECHNICAL FIELD

The invention relates to an electronic initiator unit for the electrical filing of a charge in an energetic device.

In particular the invention relates to an electronic initiator unit for use in an electrical firing system to give the ability to fire single or multiple charges in single of multiple energetic devices in a controlled manner from a remote location. The invention also relates to such an electrical firing system including a plurality of electronic initiator units and a suitable firing control means. The invention for example relates to an electronic initiator unit or electrical firing system for pyrotechnic devices, and is discussed accordingly by way of example herein, but can be seen to be applicable to any device in which a charge of energetic material such as explosive, propellant or pyrotechnic, is to be initiated directly or indirectly by an electronic initiator.

BACKGROUND

Electric firing systems are widely used in modern display pyrotechnics. Electric firing enables a pyrotechnician to fire single or multiple pyrotechnic devices in precisely controlled and complex patterns from a remote location. This has advantages both in terms of safety, in that it removes the pyrotechnician from the vicinity of the pyrotechnic charges as they are being fired, and in relation to complexity, making possible much more rapid firing of large, spaced and complex displays.

The basis of any electric firing system is the requirement for an efficient, safe remotely addressable electronic initiator to initiate the pyrotechnic charge on receipt of a firing signal.

An electric match is a common initiator used in the electric firing of pyrotechnic devices. It typically consists of a pair of electrical leads with a bridge wire coupled between them, and a pyrogenic material associated with and for example in contact with the bridge wire. The electric match acts as an initiator in that a flow of current through the circuit created by the paired leads and bridge wire causes resistance heating of the bridge wire and actuates the pyrogenic material. The electric match is positioned such that this initiates the main pyrotechnic charge, either directly or via additional intermediate charges if required.

The electric match may be mounted in a housing for example, with the pair of leads extending as connecting wires externally of the housing for connection to an external firing control circuit. For pyrotechnic display purposes, multiple electric matches associated with and positioned to initiate multiple pyrotechnic devices will typically be attached to a firing control board as the display is assembled at the display site. The usual form of connection is a bare wire clamped connection.

The provision of bare wire ends on the two connecting wires of the electric match presents a potential hazard both during transport and at certain stages of assembly. To prevent inadvertent premature firing of the match, it is necessary as far as possible to prevent the generation of stray currents within the bridge wire, and in particular to prevent the generation of stray currents that might be generated by static charges, in the presence of external electromagnetic fields etc. A standard safety procedure is to shunt the two ends of the connecting wires together to close the circuit. Most simply, the two bare wire ends may be shunted by twisting, bending or folding together into contact.

This process has a number of drawbacks. The twisting, bending or folding of the ends of the wires to create a closed loop for shunting is a time-consuming and labour intensive process and does not necessarily guarantee consistent shunt connection. Further time and labour must then be expended at the display site as the wires are unshunted before they can be incorporated into the firing circuit. As pyrotechnic displays grow more complex, this additional labour becomes significant.

It is generally desirable to develop an alternative electronic initiator such as an electric match for the electrical firing of a charge in an energetic device such as a pyrotechnic display device which mitigates some or all of these disadvantages, and in particular which provides for a shunt connection that is more reliably secured and/or more easily created and/or more easily removed at the point of assembly of the electronic initiator into a firing control circuit.

SUMMARY OF THE INVENTION

In accordance with the invention in a first aspect there is provided an electronic initiator unit for the electrical firing of a charge in an energetic device comprising: an actuation module comprising electrically in series a first conductor, an electronic actuator adapted to initiate a charge of energetic material located in its vicinity on passage of an electric current, and a second conductor; an engagement module including a first electrical connector conductively connected to the first conductor and defining a first connector contact portion spaced remotely from the first conductor and a second electrical connector conductively connected to the second conductor and defining a second connector contact portion spaced remotely from the second conductor; a shunt module including a first shunt connector defining a first shunt contact portion, a second shunt connector defining a second shunt contact portion, and a conductive shunt connection between the first and second shunt connector spaced remotely from the shunt contact portions; wherein the engagement module and the shunt module are co-operably configured so as to be engageable together such as to effect when so engaged an electrical connection between the first connector contact portion and the first shunt contact portion and between the second connector contact portion and the second shunt contact portion.

In accordance with the principles of the invention, the engagement module and shunt module effectively cooperate together to form a releasably engageable electrical plug and socket arrangement. With the shunt module detached, the remainder of the initiator unit, comprising the actuation module and the engagement module, defines an open electrical circuit that includes the electronic actuator. The remainder of the initiator unit comprises a first electrical connector in the engagement module conductively connected to a first conductor in the actuation module, for example via a suitable first connecting wire of suitable desired length, a second electrical connector in the engagement module conductively connected to the second conductor in the actuation module, for example via a second connecting wire of suitable desired length, and an electronic actuator.

The electronic actuator is adapted to initiate a charge of energetic material located in its vicinity on passage of an electric current. To actuate the electronic actuator, a suitable electrical current is caused to flow in the above circuit in familiar manner. To this extent, the electronic actuator can be of any known configuration, and is for example an electric match.

The energetic material charge is for example a pyrotechnic charge, and the invention particularly relates to an electronic initiator unit for remote firing of multiple pyrotechnic devices for display purposes, and is discussed accordingly by way of example herein. However the energetic material charge may be any charge of energetic material such as explosive, propellant or pyrotechnic that is to be initiated directly or indirectly by the electronic initiator unit of the invention.

The invention is distinctly characterised by the specific configuration of the engagement module and the cooperable configuration of the shunt module, so that the shunt module can be releasably engaged to the engagement module in order to close the circuit by creating a shunt connection between the first and second electrical conductors in the engagement module. With the shunt module in position engaged to the engagement module, a conductive connection is created between the first connector contact portion and the first shunt contact portion, a further conductive connection is created between the second connector contact portion and the second shunt contact portion, a closed circuit is created by the conductive shunt connection, and the electronic actuator is effectively shunted for safety.

This confers two advantages in particular relative the conventional shunting of an electronic actuator by the physical twisting together of connecting wires. First, a more consistent shunt connection is readily created for safe transport. Second, the removal of the shunt module frees up the engagement module to be engaged via a suitable complementary receiving structure on or in association with a firing control board to facilitate the assembly of multiple electronic initiator units as part of a firing control system.

In accordance with the principles of the invention, the engagement module and the shunt module are co-operably configured so as to be engageable together such as to effect when so engaged an electric connection between the first connector contact portion and the first shunt contact portion and between the second connector portion and the second shunt contact portion, and thus to close the shunt circuit in the manner above described. The engagement module and the shunt module thus function in the manner of a mutual engageable plug and socket arrangement.

The first and second connector contact portions and the first and second shunt contact portions may respectively comprise end portions of their respective connectors, which are disposed to be brought into conductive contact when the engagement module and the shunt module are engaged together. These end portions may for example comprise complementary projecting and receiving conducting structures.

The engagement module and the shunt module conveniently further comprise a protective and insulating housing in which the respective first and second connectors are housed and electrically isolated from each other. The respective housings of the engagement module and the shunt module are preferably co-operably structured to facilitate their mutual mechanical engagement and configured so as to effect the required electrical connection when so engaged. For example, the respective housings comprise mutually engageable projecting and recessed portions which facilitate the releasable engagement together of the two housings and additionally facilitate the location and electrical connection between the first connector contact portion and the first shunt contact portion and between the second connector contact portion and the second shunt contact portion.

For example, one of the engagement module and the shunt module comprises a plug, and the other of the engagement module and the shunt module comprises a socket. Conveniently, the engagement module comprises a plug.

The invention is distinctively characterised by the provision of a plug and socket type arrangement by means of the engagement module and the shunt module, to protect the electronic actuator when not in use, and to facilitate its connection for use into a firing circuit. It will be appreciated that the invention is suitably applicable to standard electronic actuator technology, for example in particular where the electronic actuator is an electric match.

In a possible embodiment the electronic actuator comprises an electrically ignitable pyrogenic material. In a possible embodiment the actuation module comprises a first conductor, and for example a first conducting wire, a second conductor, and for example a second conducting wire, and a bridge wire coupled therebetween, which bridge wire is provided in association with an ignitable pyrogenic material, which is for example in contact with the bridge wire.

In a possible embodiment, the actuation module further comprises a protective and/or insulting housing surrounding the said conductors, bridge wire and pyrogenic material. Conducting wires either themselves extend beyond the housing to constitute connecting wires or are connected via further elongate connecting wires to the respective first and second connectors in the actuator engagement module.

The shunt module comprises a first shunt connector defining a first shunt contact portion, for example at or towards an end thereof, a second shunt connector defining a second shunt contact portion, for example at or towards an end thereof, and a conductive connection between the first and second shunt connectors spaced remotely from the shunt contact portions, for example at or towards an end of the respective first and second shunt connectors distal from the shunt contact portions.

The shunt module may comprise a protective and/or insulating housing containing the said first and second shunt connectors.

A suitable conductive shunt connection between the first and second shunt connectors might be contained within the housing, or might comprise a conductor extending externally of the housing, which is for example a shunt wire.

The provision of a shunt module mechanically and electrically engageable to the engagement module in the manner above described confers two functional advantages.

First, engagement of the shunt module creates an effective and stable shunt connection for safety. The shunt connection is more consistently and easily provided, by attachment of the shunt module, than is the case where bare wires are twisted together. The shunt connection is not readily compromised. It requires active removal of the shunt module by pulling the two modules apart.

Second, when the shunt module is removed for use, the engagement module is made available to serve as a means for connecting the actuation module into a firing control circuit. In particular, subject to a suitably adapted firing control board being provided, a plug and play capability may be offered in which and engagement module is simply plugged into connection with a terminal on the firing control board.

Thus, in a preferred more complete system for the use of the electronic initiator units in accordance with the invention, a suitable firing control board may be provided adapted to make electrical connection with a plurality of electronic initiator units in accordance with the invention, and the firing control board is for example coupled to a firing control system which is able selectively to provide an actuating current to the various electronic actuators of the plurality of electronic initiator units in turn, for example as desired to run a pyrotechnic display.

Thus, In accordance with the invention in a more complete second aspect there is provided a system for the electrical firing of a charge in a plurality of energetic devices in a controlled manner from a remote location, the system comprising: a plurality of electronic initiator units in accordance with the first aspect of the invention; and a firing control board adapted to make electrical connection with a plurality of electronic initiator units in accordance with the first aspect of the invention.

Suitably in accordance with such a more complete system for the use of the electronic initiator units in accordance with the invention, connection to the firing control board is effected by making use of the engagement module of each of the plurality of electronic initiator units.

A number of possible ways of making connection to a suitable firing control board by making use of the engagement module of each of the plurality of electronic initiator units can be envisaged.

In a possible embodiment, the firing control board comprises a plurality of terminal connections each comprising a mounting module equivalently configured to the respective shunt modules of the electronic initiator units (for example as plug or socket as the case may be), where equivalently configured means having at least the common features of configuration necessary to enable the engagement module to engage mechanically with the mounting module in like manner to its engagement with the shunt module.

Each mounting module further comprises electrical connectors to connect the electronic initiator units into a firing control circuit defined by the firing control board. Conveniently each mounting module comprises a first terminal connector defining a first terminal contact portion, and a second terminal connector defining a second terminal contact portion, and wherein the mounting module is co-operably configured so as to be engageable to the engagement module of the initiator unit such as to effect when so engaged an electrical connection between the first connector contact portion and the first terminal contact portion and between the second connector contact portion and the second terminal contact portion.

With such a firing control board, the respective engagement modules of a plurality of electronic initiator units in accordance with the invention may simply be plugged in directly to corresponding mounting modules in the firing control board to complete a firing circuit.

More completely in this aspect therefore, there is provided a system for the electrical firing of a charge in a plurality of energetic devices in a controlled manner from a remote location, the system comprising: a plurality of electronic initiator units in accordance with the first aspect of the invention; a firing control board providing a plurality of terminals each for the electrical connection of an actuation module of one of the said plurality of electronic initiator units and for the delivery of an actuating electric current selectively to each such electronic actuator thereof; wherein each terminal comprises a mounting module including a first terminal connector defining a first terminal contact portion, and a second terminal connector defining a second terminal contact portion, and wherein the mounting module is co-operably configured so as to be engageable to the engagement module of the initiator unit such as to effect when so engaged an electrical connection between the first connector contact portion and the first terminal contact portion and between the second connector contact portion and the second terminal contact portion.

Thus, in accordance with this aspect of the invention, a firing control board is provided with a plurality of terminals each of which includes a mounting module configured in like manner to the shunt module, so that when the shunt module is removed from an initiator unit in accordance with the first aspect of the invention, the engagement module of the initiator unit of the first aspect of the invention may instead be engaged with the mounting module of the firing control board and effect an electrical connection to that mounting module.

Specifically, the engagement module and the mounting module are co-operably configured so as to be engageable together such as to effect when so engaged an electrical connection between the first connector contact portion and the first terminal contact portion and between the second connector contact portion and the second terminal contact portion.

With such a modified firing control board, the respective engagement modules of a plurality of electronic initiator units in accordance with the invention may simply be plugged in directly to the firing control board. Thereby, remote control of firing is enabled in familiar manner.

Preferred features of the shunt module and of the co-operable assembly of the shunt module to the engagement module will apply by analogy to the mounting module.

In a possible system, a bespoke firing control board may be provided, wherein the mounting modules are integrally formed on the firing control board.

In an alternative configuration, to fit to an existing firing control board having an existing system of bare wire clamp connections, an electronic initiator unit in accordance with the principles of the invention may make use of a secondary mounting module separate from the firing control board, and comprising a mounting module equivalently configured to the shunt module of the electronic initiator unit of the first aspect of the invention in the manner above described, provided with respective first and second connecting wires respectively in conductive connection with first and second mounting contact portions, the first and second connecting wires being thereby connectable to a firing control board of conventional design.

In a possible mode of use, applicable to an embodiment where the shunt module includes a shunt connector comprising an external wire, externally of any module housing, the shunt module can be put into service as a separate mounting module in accordance with the principles above described. With the shunt module in position as a plug, it acts to close and shunt the actuation circuit for transport. When the electronic initiator unit is ready to be deployed, the external wire conductive connection between the first and second shunt connectors may simply be cut, and the resultant two ends may be connected directly into a firing control board of conventional design. The shunt module thereby serves as a secondary mounting module as above described.

In accordance with the invention in a third aspect there is provided a method of shunting an electronic initiator unit for the electrical firing of a charge in an energetic device, for example for safety during storage or transit, the method comprising: providing an actuation module comprising electrically in series a first conductor, an electronic actuator configured to initiate a charge of energetic material located in its vicinity on passage of an electric current, and a second conductor; providing an engagement module including a first electrical connector conductively connected to the first conductor and defining a first connector contact portion spaced remotely from the first conductor and a second electrical connector conductively connected to the second conductor and defining a second connector contact portion spaced remotely from the second conductor; providing a shunt module including a first shunt connector defining a first shunt contact portion, a second shunt connector defining a second shunt contact portion, and a conductive connection between the first and second shunt connector spaced remotely from the shunt contact portions; wherein the engagement module and the shunt module are co-operably configured so as to be engageable together such as to effect when so engaged an electrical connection between the first connector contact portion and the first shunt contact portion and between the second connector contact portion and the second shunt contact portion; engaging the engagement module and the shunt module together to effect a shunt connection.

The method is a method of use of the unit of the first aspect of the invention, and further preferred features will be understood by analogy.

More completely, in accordance with the fourth aspect of the invention, there is provided a method for the assembly of a plurality of electronic initiator units into a firing system providing for the electrical firing of the respective charges of a plurality of energetic devices, comprising: providing a plurality of shunted electronic initiator units in accordance with the method of the third aspect of the invention; providing a firing control board with a plurality of terminals each comprising a mounting module including a first terminal connector defining a first terminal contact portion, and a second terminal connector defining a second terminal contact portion, and wherein the mounting module is co-operably configured so as to be engageable to the engagement module of the initiator unit such as to effect when so engaged an electrical connection between the first connector contact portion and the first terminal contact portion and between the second connector contact portion and the second terminal contact portion; separating the shunt module from each engagement module; engaging each engagement module with a terminal module to effect an electrical connection to the firing control board.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
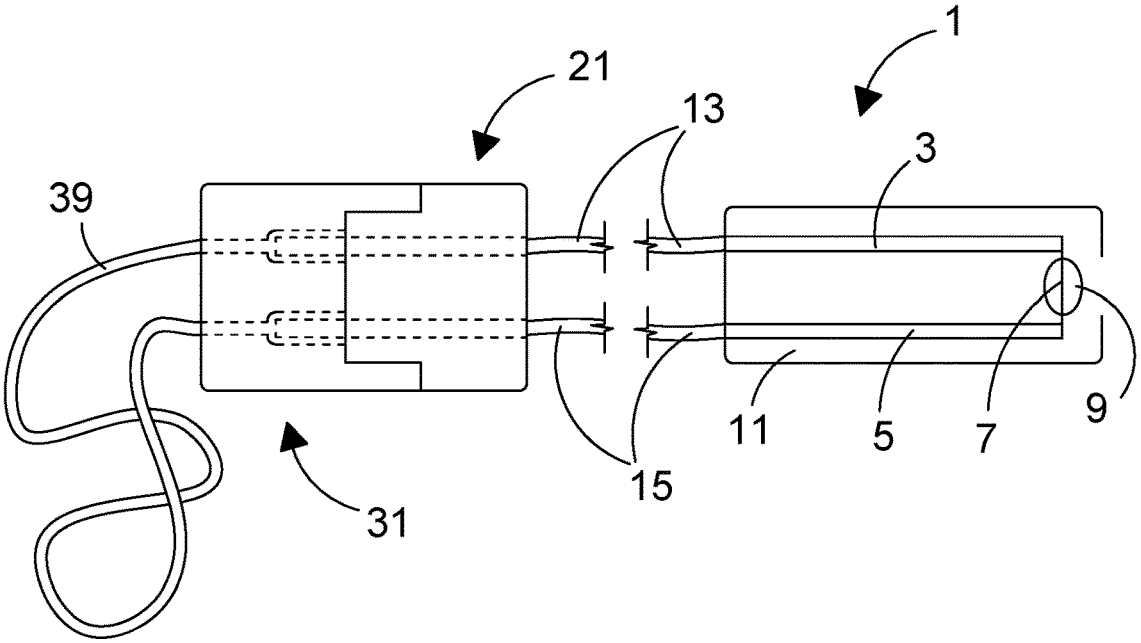
FIG. 1 illustrates an electric match, according to some embodiments.

The specific details of the single embodiment or variety of embodiments described herein are to the described system and methods of use. Any specific details of the embodiments are used for demonstration purposes only, and no unnecessary limitations or inferences are to be understood therefrom.

Before describing in detail exemplary embodiments, it is noted that the embodiments reside primarily in combinations of components and procedures related to the system and method. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

Figure 1A:
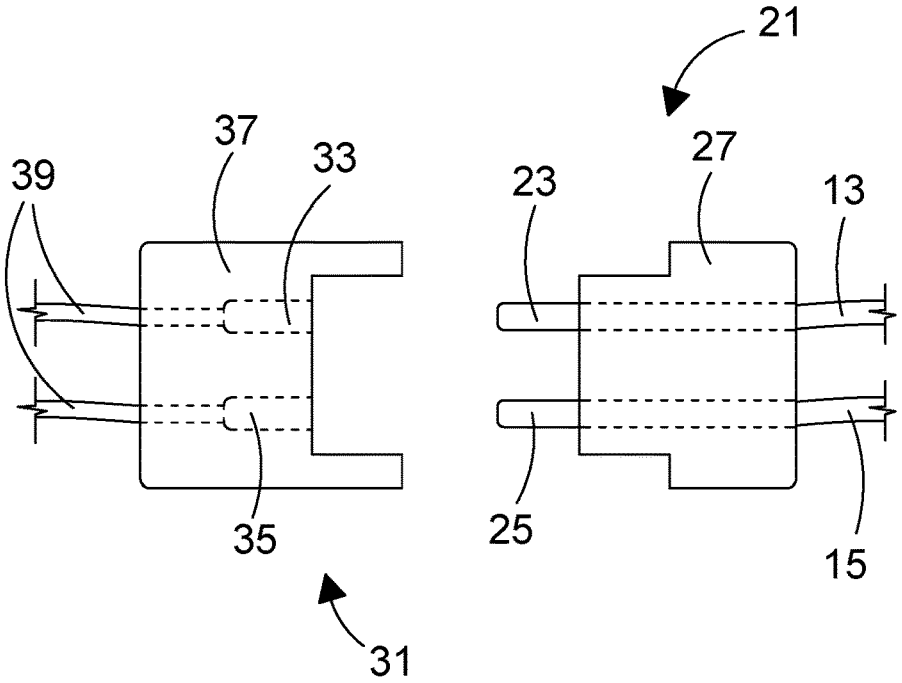

FIG. 1 shows an assembled unit in accordance with the principles of the invention in side view, with an electric match actuation module shown in cross section, and a plug and socket assembly comprising an engagement module and a shunt module shown in solid view with some internal structure represented by broken lines. FIG. 1*a* shows the engagement module and shunt module disengaged.

Referring to FIG. 1, an actuation module comprising an electric match 1 is shown in which a first elongate wire 3 and a second elongate wire 5 are provided with a bridging wire 7 between them. The bridging wire 7 is in contact with a pyrogenic composition 9. When a suitable electrical current is applied via the conducting wires 3 and 5, resistance heating of the bridging wire 7 ignites the pyrogenic material 9, and thus ignites a pyrotechnic charge (not shown) in the vicinity of which the electric match has been placed for use.

The electric match actuation module is contained within a protective insulating housing 11 in familiar manner.

Connecting wires 13, 15 extend to an engagement module 21 in the form of a plug having a protective insulting housing 27 which contains, protects and electrically isolates a pair of conducting electrodes 23, 25 which are respectively conductively continuous with the connecting wires 13, 15.

The plug formation of the engagement module is configured to releasably engage with a socket formation of a shunt module 31. The shunt module again comprises a protective and insulting housing 37, which contains, protects and electrically isolates a pair of conducting connectors 33, 35. The housing 37 is complementarily shaped with the housing 27 to serve as the socket formation and thereby to effect a releasable engagement between the two housings as the plug formation of the engagement module is inserted into the socket formation of the shunt module.

Extending projections of the electrodes 23, 25 are respectively received in the conducting connectors 33, 35 within the socket housing, which receiving connectors are in conductive connection to a shunt wire 39 that connects the two receiving contacts 33, 35 at a distal end of the socket housing. The mechanical engagement of the plug formation and the socket formation creates an electrical contact between the projecting electrodes 23, 25 and the receiving connectors 33, 35 and thereby closes the circuit.

Thus, in the configuration shown in FIG. 1, with the socket formation of the shunt module engaged with the plug formation of the engagement module, a closed loop is formed in which the electric match is effectively shunted for safety. This provides safe and secure shunting without the requirement of twisting, bending or folding the connecting wires 13, 15 to create the loop. The plug and socket solution creates a more positive and certain loop connection for shunting, but is easier and less time consuming and labour intensive both to create and to remove than is the prior art manual twisting method.

With the shunt module socket 31 formation removed (see FIG. 1*a*) the engagement module plug formation can additionally serve as a plug for engagement into a corresponding socket formation of a bespoke firing control board as part of a system for remote firing of multiple energetic charge devices, and for example multiple pyrotechnics in a pyrotechnic display.

Figure 2:
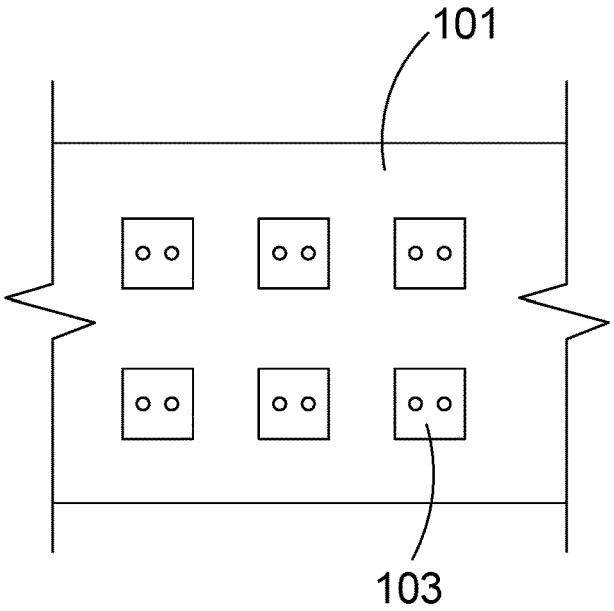
FIG. 2 illustrates a firing control board with bespoke modification for use with a plurality of electric matches, according to some embodiments.

Such a bespoke board is illustrated in FIG. 2.

Figure 3:
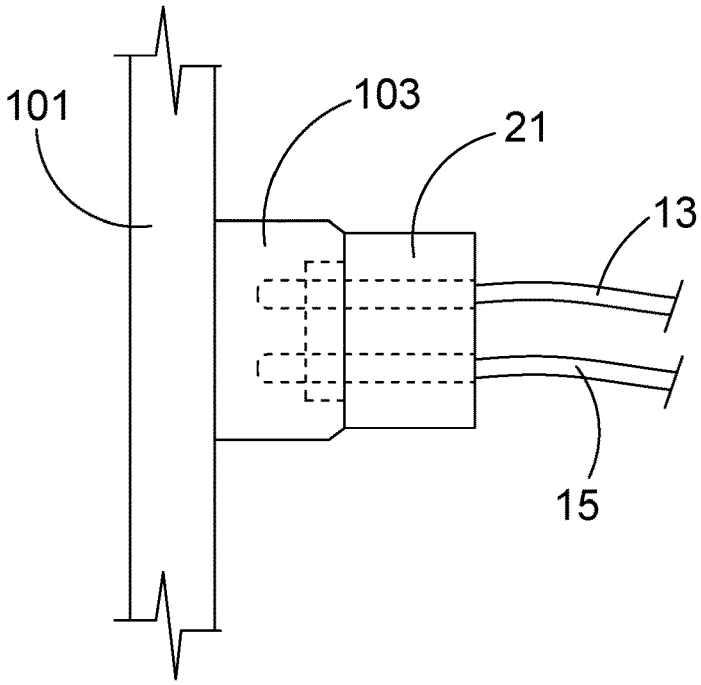
FIG. 3 illustrates a simple schematic illustration of the connection of a electric match unit into the firing control board, according to some embodiments.

A control board 101 is provided with a plurality of connecting terminals 103 each generally configured in similar manner to the shunt socket formation 31 illustrated in FIG. 1. Engagement is effected in the manner illustrated in FIG. 3, whereby the engagement plug 21 is inserted into the socket formation 103 and thereby effects an electrical connection with the firing control board 101 which may be under the control of suitable conventional electronics to fire each of the pyrotechnic or other devices so connected in a selective manner from a remote location as desired.

The creation of such a plug and play system potentially significantly reduces labour time during the preparation of a pyrotechnic show, for example for concert or event use. It may significantly reduce loading time. It ensures a more positive connection between pyrotechnic and firing system outputs, allows easier resistance testing of ignitors for example and of circuits and systems, due to the ease and speed in which the plug can be connected to those means of testing. Each ignitor could be plugged into and unplugged from such a test more easily and quickly than would be the case with bare cable systems.

Although there is an additional material cost to the production of a plug and socket system in this manner, this is likely to be insignificant compared with the potential reduction in labour time associated with the shunting for safe shipping, the unshunting for assembly, and the physical assembly of, bare wire based systems.

However, it is a particular advantage of the present invention that its general principles are similarly adaptable to existing firing control boards embodying bare wire systems. An example of such an adaptation is illustrated in FIGS. 4 and 5.

Figure 4:
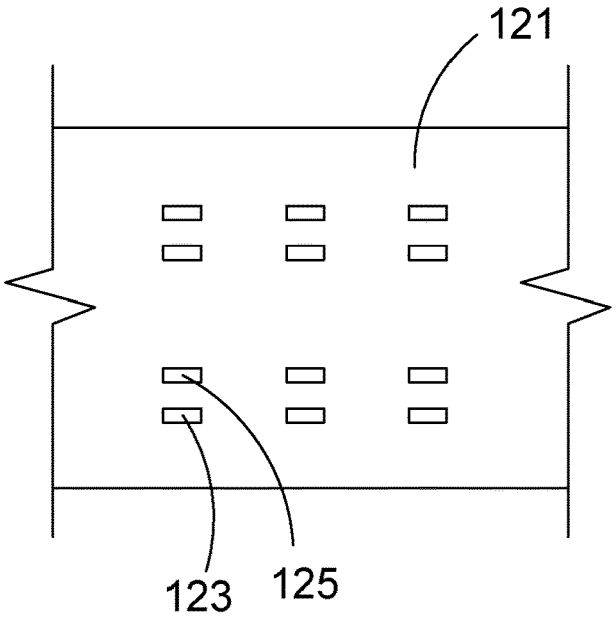
FIG. 4 illustrates a conventional firing control board, according to some embodiments.

FIG. 4 shows a conventional bare wire firing control board 121 in which simple clamped slots 123, 125 are provided for the insertion of and connection of bare wire contacts formed as extensions of the connecting wires such as are shown as wires 13 and 15 in FIG. 1.

Figure 5:
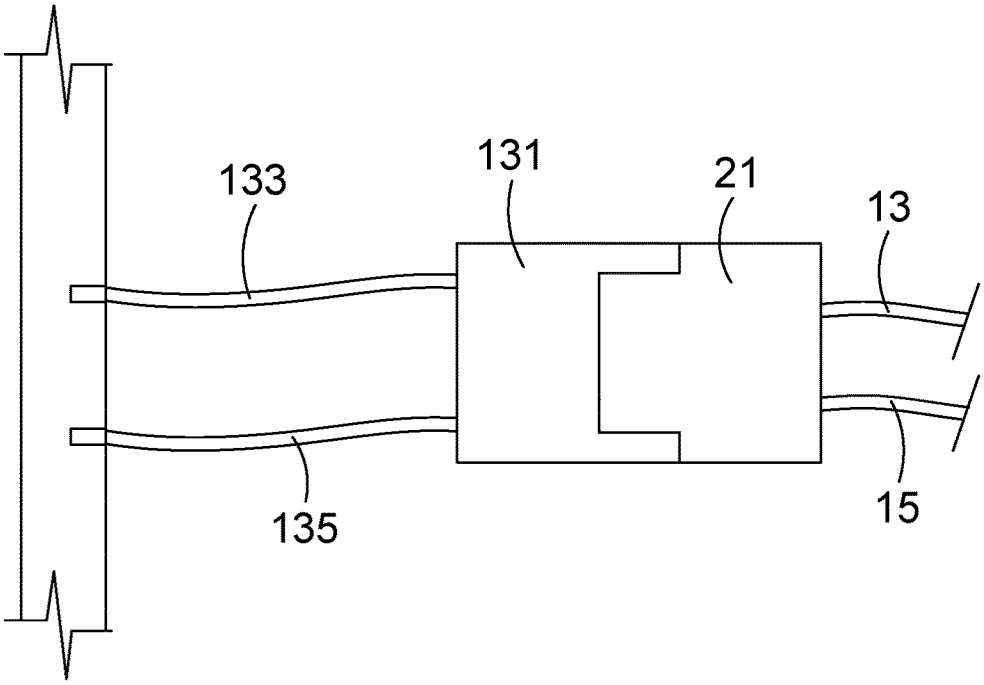
FIG. 5 illustrates a simple schematic of a suitable method of connection of an electric match unit into the conventional firing control board, according to some embodiments.

In order to modify such a system to the principles of the invention, the example shown in FIG. 5 is effective.

A terminal socket formation 131 is provided of identical configuration to the shunt module socket formation 31 of FIG. 1, configured to engaged with and form a conductive pair of contacts with the engagement plug 21 in the same manner. The terminal socket formation 131 is provided with two terminal wires 133, 135 which may be inserted into the receiving slots 123, 125 to effect a conventional bare wire connection. Thus, by provision of a simple secondary terminal module with a terminal socket formation 131, the unit of FIG. 1 is adapted for use with the conventional firing control board 121 of FIG. 4.

It may not even be necessary to provide a separate terminal module with a terminal socket formation 131. Instead, in a possible adaptation, the shunt module socket formation 31, once it has served its purpose as a means of providing a shunt loop for storage/transit of the unit, may have the shunt wire 39 cut and the end stripped and thus find service as the terminal socket module of FIG. 5.

Thus, the principles of the invention provide an electronic initiation unit based on an electric match that offers advantages in relation to both shunting and deployment both in terms of safety and in terms of reduction in labour time currently experienced. This is true whether a bespoke solution including a bespoke firing control board is envisaged, or whether a method is envisaged to enable the system to be exploited with existing bare wire control boards. The labour time associated with assembling complex pyrotechnic displays may be significantly reduced. The testing of product, in particular prior to loading a pyrotechnic effect, is simplified. Shipping becomes safer as the shunt connection between the plug and the socket is strong and robust and unlikely to come apart accidently, but is still relatively easy to remove when desired as the plug and socket are physically pulled apart.

What is claimed is:

1. An electronic initiator unit for the electrical firing of a charge in an energetic device, comprising:

an actuation module comprising electrically in series a first conductor, an electronic actuator, and a second conductor;

an engagement module including a first electrical connector conductively connected to the first conductor and defining a first connector contact portion spaced remotely from the first conductor and a second electrical connector conductively connected to the second conductor and defining a second connector contact portion spaced remotely from the second conductor; and a shunt module including a first shunt connector defining a first shunt contact portion, a second shunt connector defining a second shunt contact portion, and a conductive shunt connection between the first and second shunt connector spaced remotely from the shunt contact portions, wherein the shunt module comprises a housing containing the first and second shunt connectors and the conductive shunt connection between the first and second shunt connectors comprises a shunt wire conductor extending externally out of the housing, and wherein the engagement module and the shunt module are co-operable configured so as to be engageable together such as to effect when so engaged an electrical connection between the first connector contact portion and the first shunt contact portion and between the second connector contact portion and the second shunt contact portion.

2. The device of claim 1, wherein the first and second connector contact portions and the first and second shunt contact portions respectively comprise connector end portions of their respective connectors, which are disposed to be brought into conductive contact when the engagement module and the shunt module are engaged together.

3. The device of claim 2, wherein the connector end portions comprise complementary projecting and receiving conducting structures.

4. The device of claim 1, wherein the engagement module and the shunt module further each comprise a housing in which the respective first and second connectors are housed and electrically isolated from each other.

5. The device of claim 4, wherein the respective housings of the engagement module and the shunt module are cooperably structured to facilitate their mutual mechanical engagement.

6. The device of claim 5, wherein the respective housings of the engagement module and the shunt module are cooperably structured to facilitate their mutual mechanical engagement.

7. The device of claim 1, wherein one of the engagement module and the shunt module comprises a plug, and the other one of the engagement module and the shunt module comprises a socket.

8. The device of claim 7, wherein the engagement module comprises a plug.

9. The device of claim 7, wherein the plug and socket are operable to protect the electronic actuator when not in use.

10. The device of claim 1, wherein the electronic actuator comprises an electrically ignitable pyrogenic material.

11. The device of claim 1, wherein the actuation module comprises a first conductor, a second conductor, and a bridge wire coupled therebetween, which bridge wire is provided in association with an ignitable pyrogenic material.

12. The device of claim 11, wherein the actuation module further comprises a protective and insulating housing surrounding the said conductors, bridge wire and pyrogenic material.

* * * * *